US009807830B1

(12) United States Patent
Xiong et al.

(10) Patent No.: US 9,807,830 B1
(45) Date of Patent: Oct. 31, 2017

(54) LED DRIVER CIRCUIT WITH STEP CONFIGURABLE OUTPUT

(71) Applicant: Universal Lighting Technologies, Inc., Madison, AL (US)

(72) Inventors: Wei Xiong, Madison, AL (US); John Helms, Madison, AL (US)

(73) Assignee: UNIVERSAL LIGHTING TECHNOLOGIES, INC., Madison, AL (US)

( * ) Notice: Subject to any disclaimer, the term of this patent is extended or adjusted under 35 U.S.C. 154(b) by 0 days.

(21) Appl. No.: 15/209,851

(22) Filed: Jul. 14, 2016

Related U.S. Application Data

(60) Provisional application No. 62/203,188, filed on Aug. 10, 2015.

(51) Int. Cl.
*H05B 33/08* (2006.01)

(52) U.S. Cl.
CPC ..... *H05B 33/0815* (2013.01); *H05B 33/0845* (2013.01)

(58) Field of Classification Search
CPC combination set(s) only.
See application file for complete search history.

(56) References Cited

U.S. PATENT DOCUMENTS

2015/0331436 A1* 11/2015 Vonach ..... G05F 1/66 700/297

* cited by examiner

*Primary Examiner* — Douglas W Owens
*Assistant Examiner* — Jianzi Chen
(74) *Attorney, Agent, or Firm* — Patterson Intellectual Property Law, P.C.; Mark J. Patterson; Gary L. Montle

(57) ABSTRACT

An LED driver apparatus provides discrete output current configuration. User interfaces such as dip switches enable user selection of output current settings. LED driver circuitry includes an inverter, a primary transformer winding coupled to the inverter switches and providing resonant inductance, and a secondary transformer winding coupled on a first end to an output rectifier. Various circuit branches are coupled in parallel between the output rectifier and the secondary winding, each including a switching element driven between open and closed states associated with the user-selected output current setting. The circuit branches may be coupled to respective secondary winding taps, wherein output current is regulated according to an effective turns ratio defined by the closed circuit branch. Alternatively, the circuit branches may be coupled to one end of the secondary winding but include current limiting capacitors, wherein one or more closed circuit branches define an equivalent capacitance and associated output current.

20 Claims, 3 Drawing Sheets

LED DRIVER CIRCUIT WITH STEP CONFIGURABLE OUTPUT

CROSS-REFERENCES TO RELATED APPLICATIONS

This application claims benefit of U.S. Provisional Patent Application No. 62/203,188, filed Aug. 10, 2015, and which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to driver circuits for light emitting diode ("LED") lighting sources. More particularly, the invention relates to LED driver circuits with step configurable output stages.

LED lighting sources are becoming more and more popular, at least because of their relatively high lumen output per watt and superior longevity. An LED array is a current driven device, so LED lighting sources typically require a driver to run LEDs and accordingly generate lighting output. One desirable consideration in LED driver design is that the LED driver output is configurable, which means that customers can selectively change the output within a certain range. However, conventional tools for realizing this feature include very complicated tuning circuits and micro-processors, which increase the product cost and size dramatically.

At least due to the competitive nature of the LED lighting market, it would be very desirable to have a simpler and lower cost solution for this type of application.

BRIEF SUMMARY OF THE INVENTION

Various embodiments of an apparatus and method are disclosed herein for step configuration of an LED driver circuit to address the aforementioned problems and desired features.

A particular embodiment of an LED driver apparatus as disclosed herein provides discrete output current configuration. User interfaces such as dip switches enable user selection of output current settings. LED driver circuitry includes an inverter, a primary transformer winding coupled to the inverter switches and providing resonant inductance, and a secondary transformer winding coupled on a first end to an output rectifier. Various circuit branches are coupled in parallel between the output rectifier and the secondary winding, each including a switching element driven between open and closed states associated with the user-selected output current setting.

The circuit branches may be coupled to respective secondary winding taps, wherein output current is regulated according to an effective turns ratio defined by the closed circuit branch.

Alternatively, the circuit branches may be coupled to one end of the secondary winding but include current limiting capacitors, wherein one or more closed circuit branches define an equivalent capacitance and associated output current.

DETAILED DESCRIPTION OF THE INVENTION

Figure 1:
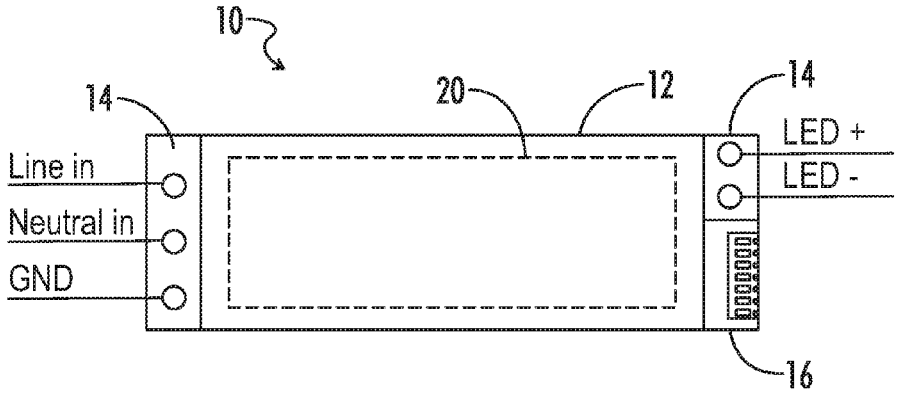
FIG. 1 is a block diagram representing an embodiment of an apparatus as disclosed herein.
Figure 2:
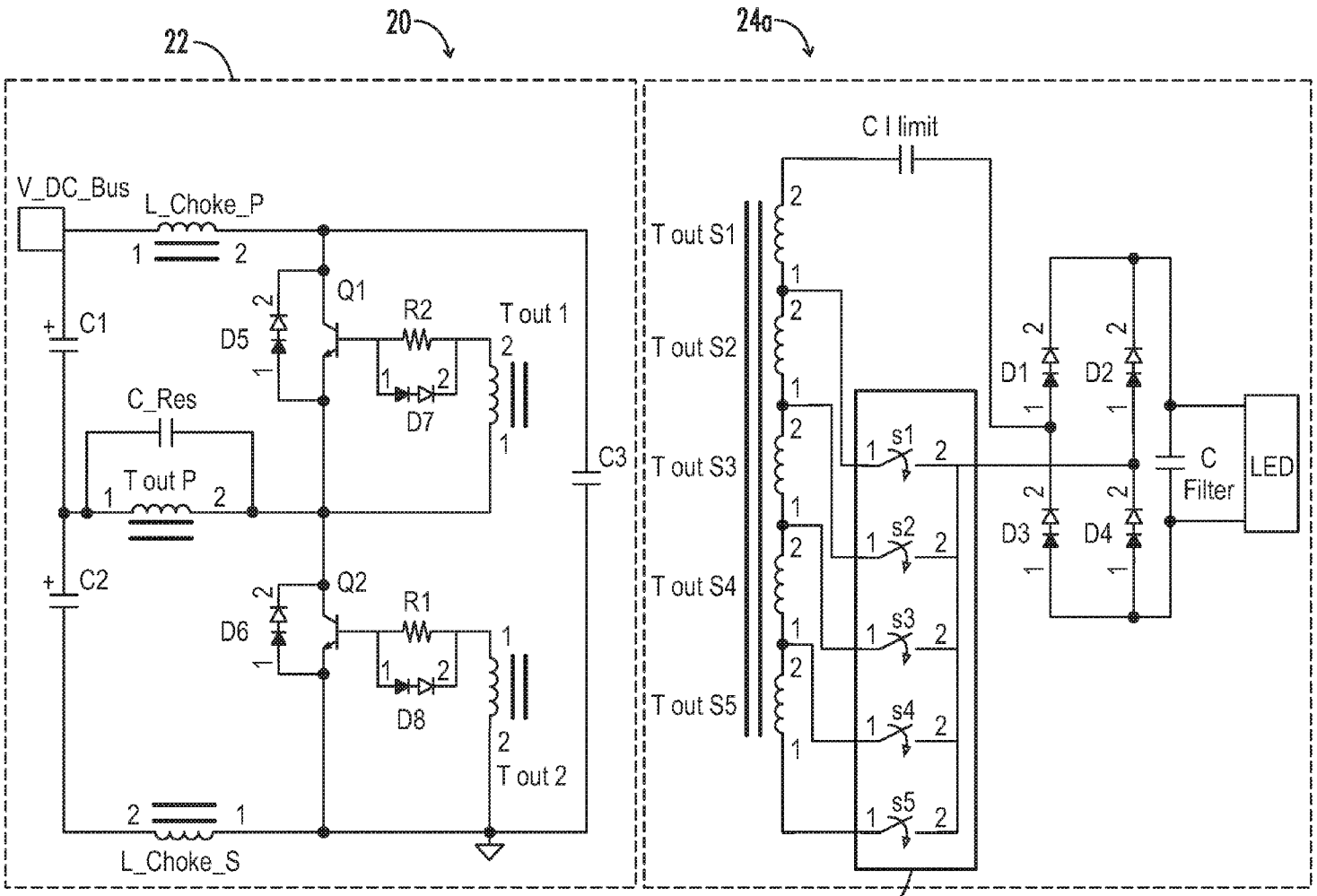
FIG. 2 is a circuit block diagram representing one exemplary embodiment of LED circuitry according to the apparatus of FIG. 1.
Figure 3:
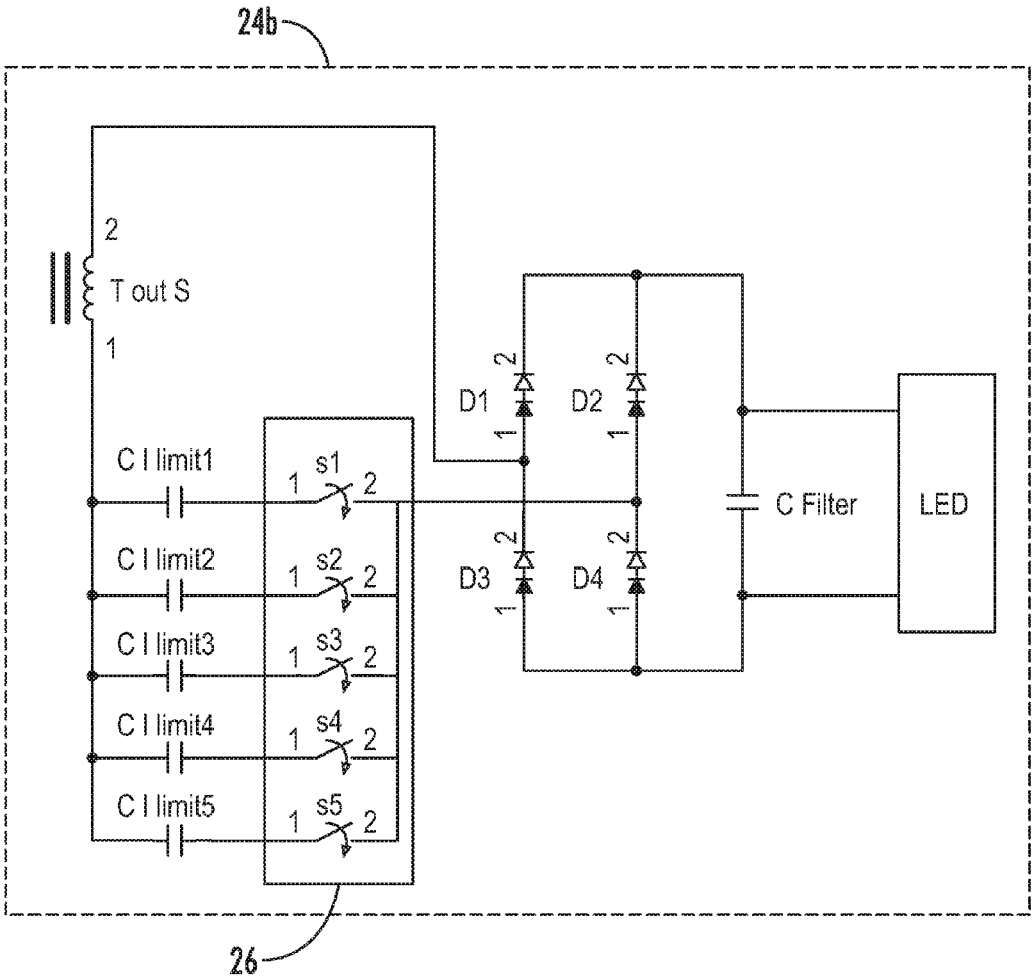
FIG. 3 is a circuit block diagram representing another exemplary embodiment of LED circuitry according to the apparatus of FIG. 1.

Referring generally to FIGS. 1-3, various exemplary embodiments of an inventive LED driver topology may now be described in detail, wherein an output configuration may be discretely (rather than continuously) implemented in order to reduce cost and driver complexity. Where the various figures may describe embodiments sharing various common elements and features with other embodiments, similar elements and features are given the same reference numerals and redundant description thereof may be omitted below.

Referring first to FIG. 1, an exemplary embodiment of an LED driver apparatus 10 as disclosed herein may include a mechanical housing 12 further provided with one or more input/output interfaces 14 to receive five lead wires, i.e., for a mains line input, mains neutral input, earth ground, a first LED output (i.e., +), and a second LED output (i.e., −). The housing 12 is further provided with a user interface module 16 such as an output current selection switch array, for example arranged at the output end of the housing. By enabling the user to change the configuration of the switch array, the driver is reconfigured accordingly such that a different LED output current may be obtained from an LED driver circuit 20 disposed within the housing. The potential user interface configurations may typically be discrete in nature, which realizes the discrete LED output current configuration as previously discussed.

Referring next to FIG. 2, in an exemplary embodiment of an LED driver circuit 20, a current-fed self-oscillating parallel resonant inverter topology may be a very good and reliable solution for implementing DC-AC-DC power conversion. It is very simple and no IC or micro-processor is needed to control the LED output current if designed properly.

As shown in FIG. 2, there are two major blocks in the driver, namely, a primary converter side 22 and a secondary output stage 24. In an embodiment, a diode rectifier (not shown) is coupled to receive an AC mains input from the lead wires coupled to the housing, and further configured as one of ordinary skill in the art may appreciate to output a DC input to the power conversion stage 22. The input of the converter, V_DC_bus, could be either received directly from the diode rectifier or alternatively a power factor correction (PFC, not shown) stage coupled between the rectifier and the converter.

Referring again to the embodiment as represented in FIG. 2, relatively large electrolytic elements C1 and C2 are provided, and which may for example buffer the DC power for the converter. An inductive element L_choke in the exemplary embodiment shown has two windings, L_choke_p and L_choke_s. and effectively turns the DC input voltage into a DC current source to switching elements Q1 and Q2. Switching elements Q1 and Q2 in one embodiment are power bipolar transistors arranged in a half-bridge configuration. Free-wheeling diodes D5 and D6 may be implemented to bypass the negative current from switching elements Q1 and Q2.

The converter stage may further include resonant circuit components, which as shown in FIG. 2 may be implemented by a first capacitor C3 coupled on a first end to the DC input V_DC_bus and on a second end to circuit ground, a resonant inductance T_out coupled on a first end to a node between the switching elements Q1 and Q2 and on a second end to a node between the electrolytics C1 and C2, and a resonant capacitance coupled in parallel with the resonant inductance. For such an embodiment of the resonant circuit, the resonant frequency may be approximately determined by:

$$fres = \frac{1}{2\pi\sqrt{L_{T_out}\cdot(4C_3 + C_{res})}} \tag{1}$$

when no load is present at the output terminals of the housing, or by:

$$fres = \frac{1}{2\pi\sqrt{L_{T_out}\cdot\left(4C_3 + C_{res} + \frac{C_{I_limit}}{N^2}\right)}} \tag{2}$$

when the output is loaded, wherein N is the turns ratio between the respective primary and secondary windings of output transformer T_out.

Self-oscillation for an inverter circuit comprising the switching elements Q1 and Q2 may be achieved using drive windings T_out_1 and T_out_2, respectively. The first drive winding T_out_1 is coupled on a first end to the node between the switching elements Q1 and Q2, and on a second end to drive current limiting resistor R2. A fast turn off diode D7 is coupled in parallel with the resistor R2, with each of the diode D7 and the resistor R2 coupled in between the first drive winding T_out_1 and the control electrode of the first switching element Q1 to help speed up turn-off of the switching element Q1. Likewise, the second drive winding T_out_2 is coupled on a first end to the circuit ground, and on a second end to drive current limiting resistor R1. A fast turn off diode D8 is coupled in parallel with the resistor R1, with each of the diode D8 and the resistor R1 coupled in between the first base drive winding T_out_2 and the control electrode of the second switching element Q2 to help speed up turn-off of the switching element Q2.

In steady state the RMS voltage across the primary winding of the output transformer T_out_p is defined by:

$$V_{T_out_p_rms} = \frac{\pi\cdot V_{DC_bus}}{4\sqrt{2}} \tag{3}$$

If the turns ratio between the primary winding T_out_p and magnetically corresponding secondary windings T_out_s is N, the secondary RMS voltage is defined by:

$$V_{T_out_s_rms} = \frac{\pi\cdot V_{DC_bus}}{4\sqrt{2}}\cdot N \tag{4}$$

In an embodiment as shown in FIG. 2, the driver secondary side 24*a* includes five secondary windings T_out_s1, T_out_s2, T_out_s3, T_out_s4, T_out_s5 connected in series. The turns ratio between each of the aforementioned secondary windings and the primary winding for the output transformer is defined as N1, N2, N3, N4 and N5, respectively. In various embodiments, one of skill in the art may appreciate that more windings could be connected in series depending on the resolution of output current configuration resolution. It may further be understood that an increase in the number of secondary windings used, the better the output current configuration resolution.

An output current limiting capacitor C_I_limit is coupled on a first end to T_out_s1, on a first end of the series connection of secondary windings. An output rectifier circuit in an embodiment includes output rectifier diodes D1-D4 that convert AC current to DC current in order to supply the output load (i.e., LED arrays). The second end of the output current limiting capacitor in the embodiment shown is coupled to a node between two diodes D1, D3 defining a first output rectifier branch. A high frequency filter capacitor C_filter is coupled across the first output rectifier branch and a second output rectifier branch including diodes D2, D4 connected in series, and further across output terminals 14 associated with the LED load. A switch bank 26 is defined by switches S1, S2, S3, S4 and S5 coupled in parallel. Each switch S1, S2, S3, S4, S5 is coupled on a first end to a tap of a respective secondary winding T_out_s1, T_out_s2, T_out_s3, T_out_s4, T_out_s5. Each switch is further commonly coupled on its second end to a node between the diodes D2, D4 in the second output rectifier branch.

The switches may in an exemplary embodiment correspond to a like number of switches in the switch array 16. When the first switch S1 is closed and all others are open, corresponding for example to a first configuration setting from the user interface 16, the output current may be defined by:

$$I_{LED_out} = \frac{2\sqrt{2}}{\pi}\cdot\left|\frac{V_{T_out_s1_rms}}{\frac{1}{j\cdot 2\cdot\pi\cdot f\cdot C_{I_limit}} + R_{led}}\right| = \frac{2\sqrt{2}}{\pi}\cdot\left|\frac{\frac{\pi\cdot V_{DC_bus}}{4\sqrt{2}}\cdot N_1}{\frac{1}{j\cdot 2\cdot\pi\cdot f\cdot C_{I_limit}} + R_{led}}\right| \tag{5}$$

If the impedance of the current limiting capacitor C_I_limit is greater than that of the load R_led, the output current can be simplified to:

$$I_{LED_out} = \frac{2\sqrt{2}}{\pi}\cdot\left|\frac{\frac{\pi\cdot V_{DC_bus}}{4\sqrt{2}}\cdot N_1}{\frac{1}{j\cdot 2\cdot\pi\cdot f\cdot C_{I_limit}}}\right| \tag{6}$$

-continued $$\text{if } \left|\frac{1}{j\cdot 2\cdot\pi\cdot f\cdot C_{I_limit}}\right| >> R_{led}$$

By simple substitution of the frequency definition provided above in equation (2) into the equation (6) we have:

$$I_{LED_out} = \frac{2\sqrt{2}}{\pi}\cdot\left|\frac{\frac{\pi\cdot V_{DC_bus}}{4\sqrt{2}}\cdot N_1}{\frac{1}{j\cdot 2\cdot\pi\cdot C_{I_limit}}}\cdot\frac{1}{2\pi\sqrt{L_{T_out}\cdot\left(4C_3+C_{res}+\frac{C_{I_limit}}{N_1^2}\right)}}\right| \quad (7)$$

$$\text{if } \left|\frac{1}{j\cdot 2\cdot\pi\cdot f\cdot C_{I_limit}}\right| >> R_{led}$$

From equation (7) we can see that the LED output current may be substantially irrelevant to the LED load when the current limiting capacitance C_I_limit is small enough. The turns ratio N is therefore the variable that effectively determines the LED current.

As a result, we may further represent all of the output current definitions when any one of the switches S1, S2, S3, S4 and S5 is closed:

For example, when the first switch S1 is closed:

$$I_{LED_out} = \frac{2\sqrt{2}}{\pi}\cdot\left|\frac{\frac{\pi\cdot V_{DC_bus}}{4\sqrt{2}}\cdot N_1}{\frac{1}{j\cdot 2\cdot\pi\cdot C_{I_limit}}}\cdot\frac{1}{2\pi\sqrt{L_{T_out}\cdot\left(4C_3+C_{res}+\frac{C_{I_limit}}{N_1^2}\right)}}\right|$$

When the second switch S2 is closed:

$$I_{LED_out} = \frac{2\sqrt{2}}{\pi}\cdot\left|\frac{\frac{\pi\cdot V_{DC_bus}}{4\sqrt{2}}\cdot(N_1+N_2)}{\frac{1}{j\cdot 2\cdot\pi\cdot C_{I_limit}}}\cdot\frac{1}{2\pi\sqrt{L_{T_out}\cdot\left(4C_3+C_{res}+\frac{C_{I_limit}}{(N_1+N_2)^2}\right)}}\right|$$

When the third switch S3 is closed:

$$I_{LED_out} = \frac{2\sqrt{2}}{\pi}\cdot\left|\frac{\frac{\pi\cdot V_{DC_bus}}{4\sqrt{2}}\cdot(N_1+N_2+N_3)}{\frac{1}{j\cdot 2\cdot\pi\cdot C_{I_limit}}}\cdot\frac{1}{2\pi\sqrt{L_{T_out}\cdot\left(4C_3+C_{res}+\frac{C_{I_limit}}{(N_1+N_2+N_3)^2}\right)}}\right|$$

When the fourth switch S4 is closed:

$$I_{LED_out} = \frac{2\sqrt{2}}{\pi}\cdot\left|\frac{\frac{\pi\cdot V_{DC_bus}}{4\sqrt{2}}\cdot(N_1+N_2+N_3+N_4)}{\frac{1}{j\cdot 2\cdot\pi\cdot C_{I_limit}}}\cdot\frac{1}{2\pi\sqrt{L_{T_out}\cdot\left(4C_3+C_{res}+\frac{C_{I_limit}}{(N_1+N_2+N_3+N_4)^2}\right)}}\right|$$

When the fifth switch S5 is closed:

$$I_{LED_out} = \frac{2\sqrt{2}}{\pi}\cdot\left|\frac{\frac{\pi\cdot V_{DC_bus}}{4\sqrt{2}}\cdot(N_1+N_2+N_3+N_4+N_5)}{\frac{1}{j\cdot 2\cdot\pi\cdot C_{I_limit}}}\cdot\frac{1}{2\pi\sqrt{L_{T_out}\cdot\left(4C_3+C_{res}+\frac{C_{I_limit}}{(N_1+N_2+N_3+N_4+N_5)^2}\right)}}\right|$$

One of skill in the art may appreciate from the preceding equations that an output LED current can be dynamically selected by closing any one of the associated switches to set a pre-designed current level. By reference to the exemplary embodiment in FIG. 1, the user interface 16 contains output current selection switches corresponding directly to switches S1 to S5.

Referring next to FIG. 3, an alternative method to preset output current may be provided via another embodiment of the secondary circuit 24*b*. The secondary winding T_out_s is coupled on a first end directly to the node between the diodes D1, D3 in the first output rectifier branch. Each of the switches S1, S2, S3, S4, S5 in the switch bank 26 are still coupled on one end to the node between the diodes D2, D4 in the second output rectifier branch, but are in the second embodiment now coupled on their other ends to first ends of respective current limiting capacitors C_I_limit1, C_I_limit2, C_I_limit3, C_I_limit4, C_I_limit5. Opposing second ends of the current limiting capacitors are commonly coupled to the second end of the secondary winding T_out_s. Instead of changing the turns ratio of the secondary winding in accordance with a user selection, in accordance with the embodiment shown in FIG. 3 the effective current limiting capacitance C_I_limit can be dynamically changed to set the output current.

Pursuant to the same calculations as provided above, the output current definitions may be presented as follows when any one of the switches S1, S2, S3, S4 and S5 is closed.

For example, when the first switch S1 is closed:

$$I_{LED_out} = \frac{2\sqrt{2}}{\pi}\cdot\left|\frac{\frac{\pi\cdot V_{DC_bus}}{4\sqrt{2}}\cdot N}{\frac{1}{j\cdot 2\cdot\pi\cdot C_{I_limit1}}}\cdot\frac{1}{2\pi\sqrt{L_{T_out}\cdot\left(4C_3+C_{res}+\frac{C_{I_limit1}}{N^2}\right)}}\right|$$

When the second switch S2 is closed:

$$I_{LED_out} = \frac{2\sqrt{2}}{\pi} \cdot \left| \frac{\frac{\pi \cdot V_{DC_bus}}{4\sqrt{2}} \cdot N}{\frac{1}{j \cdot 2 \cdot \pi \cdot C_{I_limit2}}} \cdot \frac{1}{2\pi\sqrt{L_{T_out} \cdot \left(4C_3 + C_{res} + \frac{C_{I_limit2}}{N^2}\right)}} \right|$$

When the third switch S3 is closed:

$$I_{LED_out} = \frac{2\sqrt{2}}{\pi} \cdot \left| \frac{\frac{\pi \cdot V_{DC_bus}}{4\sqrt{2}} \cdot N}{\frac{1}{j \cdot 2 \cdot \pi \cdot C_{I_limit3}}} \cdot \frac{1}{2\pi\sqrt{L_{T_out} \cdot \left(4C_3 + C_{res} + \frac{C_{I_limit3}}{N^2}\right)}} \right|$$

When the fourth switch S4 is closed:

$$I_{LED_out} = \frac{2\sqrt{2}}{\pi} \cdot \left| \frac{\frac{\pi \cdot V_{DC_bus}}{4\sqrt{2}} \cdot N}{\frac{1}{j \cdot 2 \cdot \pi \cdot C_{I_limit4}}} \cdot \frac{1}{2\pi\sqrt{L_{T_out} \cdot \left(4C_3 + C_{res} + \frac{C_{I_limit4}}{N^2}\right)}} \right|$$

When the fifth switch S5 is closed:

$$I_{LED_out} = \frac{2\sqrt{2}}{\pi} \cdot \left| \frac{\frac{\pi \cdot V_{DC_bus}}{4\sqrt{2}} \cdot N}{\frac{1}{j \cdot 2 \cdot \pi \cdot C_{I_limit5}}} \cdot \frac{1}{2\pi\sqrt{L_{T_out} \cdot \left(4C_3 + C_{res} + \frac{C_{I_limit5}}{N^2}\right)}} \right|$$

In an embodiment as described with respect to FIG. 3, multiple switches in the switch bank 26 may be closed at the same time to preset the output current. When multiple switches are closed, the associated current limiting capacitances C_I_limit will be added together because they are connected in parallel. We may accordingly define the total current limiting capacitance as below:

$$C_{total} = \sum_{k=1}^{5} C_{I_limit_k}$$

If any one or more of the switches close, k will count in the sum. For example, if each of switches S1, S2 and S5 are closed, the total (effective) current limiting capacitance C_total will be:

$$C_{total} = C_{I_limit1} + C_{I_limit2} + C_{I_limit5}$$

As a result, the LED output current can be defined for the situation when multiple switches are closed, further pursuant to an associated user selection:

$$I_{LED_out} = \frac{2\sqrt{2}}{\pi} \cdot \left| \frac{\frac{\pi \cdot V_{DC_bus}}{4\sqrt{2}} \cdot N}{\frac{1}{j \cdot 2 \cdot \pi \cdot C_{total}}} \cdot \frac{1}{2\pi\sqrt{L_{T_out} \cdot \left(4C_3 + C_{res} + \frac{C_{total}}{N^2}\right)}} \right|$$

Therefore, one of skill in the art may readily appreciate that an LED driver topology as disclosed herein may enable simple dynamic selection from each of a plurality of discrete output current settings by an end user. The cost and size of such a driver is substantially minimized with respect to conventional techniques.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices. The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

The terms "switching element" and "switch" may be used interchangeably and may refer herein to at least: a variety of transistors as known in the art (including but not limited to FET, BJT, IGBT, IGFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art.

Terms such as "providing," "processing," "supplying," "determining," "calculating" or the like may refer at least to an action of a computer system, computer program, signal processor, logic or alternative analog or digital electronic device that may be transformative of signals represented as physical quantities, whether automatically or manually initiated.

The terms "controller," "control circuit" and "control circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

Depending on the embodiment, certain acts, events, or functions of any of the algorithms described herein can be performed in a different sequence, can be added, merged, or left out altogether (e.g., not all described acts or events are necessary for the practice of the algorithm). Moreover, in certain embodiments, acts or events can be performed concurrently, e.g., through multi-threaded processing, interrupt processing, or multiple processors or processor cores or on other parallel architectures, rather than sequentially.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. An LED driver comprising:

an input power converter coupled to a DC input and configured to generate AC power at an output of the power converter;

a resonant circuit comprising a primary winding of a power transformer coupled to the output of the power converter;

a secondary winding of the power transformer coupled on a first end to a first output rectifier branch;

a plurality of circuit branches coupled in parallel on their respective first ends to a second output rectifier branch, and on their respective second ends to a corresponding plurality of taps on the secondary winding of the power transformer, each of the circuit branches comprising a switching element user-selectably driven between an open and closed state, wherein a closed one of the plurality of switching elements defines a number of turns between the first end and a second end of the secondary winding corresponding to the respective tap, and wherein an output current through the first and second output rectifier branches is defined according to one or more of the switching elements in the circuit branches being closed.

2. The LED driver of claim 1, wherein the output current through the first and second output rectifier branches is defined by the number of turns between the first end of the secondary winding and a second end corresponding to the respective tap for a closed one of the plurality of switching elements.

3. The LED driver of claim 1, the input power converter comprising first and second switching elements coupled in series to define the output of the power converter at a node between the first and second switching elements.

4. The LED driver of claim 3, further comprising:

a first drive winding coupled on a first end to the node between the first and second switching elements, and on a second end to a control electrode for the first switching element; and a second drive winding coupled on a first end to an input circuit ground, and on a second end to a control electrode for the second switching element, wherein current provided through the respective drive windings causes self-oscillation of the first and second switching elements.

5. The LED driver of claim 4, wherein the primary winding of the power transformer comprises a resonant inductance for the resonant circuit, and the resonant circuit further comprises a resonant capacitance coupled in parallel with the primary winding.

6. The LED driver of claim 1, further comprising:

a mechanical housing configured with an input terminal block to receive input mains AC power, an output terminal block to provide output DC power to an LED array, and a user interface configured to enable user selection from a plurality of discrete output current settings;

wherein the switching elements for each of the circuit branches are driven between an open and closed state associated with a user-selected output current setting; and wherein the first and second output rectifier branches are coupled in parallel across first and second terminals of the output terminal block.

7. The LED driver of claim 6, wherein the user interface comprises a plurality of user selectable switches corresponding to the plurality of circuit branches, wherein the switching element for a given circuit branch is driven between an open and closed state based on a condition of an associated user selectable switch.

8. The LED driver of claim 1, further comprising:

first and second DC buffering capacitors coupled in series between the DC input and an input circuit ground; and wherein the input power converter comprises first and second inverter switching elements coupled across the first and second DC buffering capacitors, and the primary transformer winding is coupled on a first end to the node between the inverter switching elements and on a second end to a node between the first and second DC buffering capacitors.

9. An LED driver comprising:

an input power converter coupled to a DC input and configured to generate AC power at an output of the power converter;

a resonant circuit comprising a primary winding of a power transformer coupled to the output of the power converter;

a secondary winding of the power transformer coupled on a first end to a first output rectifier branch;

a plurality of circuit branches coupled in parallel on their respective first ends to a second output rectifier branch, and on their respective second ends to a second end of the secondary winding of the power transformer, each of the circuit branches comprising a current limiting capacitor coupled in series with a switching element user-selectably driven between an open and closed state, and wherein an output current through the first and second output rectifier branches is defined according to one or more of the switching elements in the circuit branches being closed.

10. The LED driver of claim 9, wherein a closed one or more of the plurality of switching elements defines an output current through the first and second output rectifier branches corresponding to an effective capacitance of the circuit branches having the one or more closed switching elements.

11. The LED driver of claim 9, the input power converter comprising first and second switching elements coupled in series to define the output of the power converter at a node between the first and second switching elements.

12. The LED driver of claim 11, further comprising:

a first drive winding coupled on a first end to the node between the first and second switching elements, and on a second end to a control electrode for the first switching element; and a second drive winding coupled on a first end to an input circuit ground, and on a second end to a control electrode for the second switching element, wherein current provided through the respective drive windings causes self-oscillation of the first and second switching elements.

13. The LED driver of claim 12, wherein the primary winding of the power transformer comprises a resonant inductance for the resonant circuit, and the resonant circuit further comprises a resonant capacitance coupled in parallel with the primary winding.

14. The LED driver of claim 9, further comprising:

a mechanical housing configured with an input terminal block to receive input mains AC power, an output terminal block to provide output DC power to an LED array, and a user interface configured to enable user selection from a plurality of discrete output current settings;

wherein the switching elements for each of the circuit branches are driven between an open and closed state associated with a user-selected output current setting; and wherein the first and second output rectifier branches are coupled in parallel across first and second terminals of the output terminal block.

15. The LED driver of claim 14, wherein the user interface comprises a plurality of user selectable switches corresponding to the plurality of circuit branches, wherein the switching element for a given circuit branch is driven between an open and closed state based on a condition of an associated user selectable switch.

16. The LED driver of claim 9, further comprising:

first and second DC buffering capacitors coupled in series between the DC input and an input circuit ground; and wherein the input power converter comprises first and second inverter switching elements coupled across the first and second DC buffering capacitors, and the primary transformer winding is coupled on a first end to the node between the inverter switching elements and on a second end to a node between the first and second DC buffering capacitors.

17. An LED driver comprising:

an input power converter comprising first and second switching elements coupled in series to a DC input and configured to generate AC power at a node between the first and second switching elements;

a first drive winding coupled on a first end to the node between the first and second switching elements, and on a second end to a control electrode for the first switching element;

a second drive winding coupled on a first end to an input circuit ground, and on a second end to a control electrode for the second switching element, wherein current provided through the respective drive windings causes self-oscillation of the first and second switching elements;

a resonant circuit comprising a primary winding of a power transformer coupled to the node between the first and second switching elements;

a secondary winding of the power transformer coupled on a first end to a first output rectifier branch; and a plurality of circuit branches coupled in parallel on their respective first ends to a second output rectifier branch, and on their respective second ends to the secondary winding of the power transformer, each of the circuit branches comprising a switching element user-selectably driven between an open and closed state, wherein an output current through the first and second output rectifier branches is defined according to one or more of the switching elements in the circuit branches being closed.

18. The LED driver of claim 17, further comprising:

a mechanical housing configured with an input terminal block to receive input mains AC power, an output terminal block to provide output DC power to an LED array, and a user interface configured to enable user selection from a plurality of discrete output current settings;

wherein the switching elements for each of the circuit branches are driven between an open and closed state associated with a user-selected output current setting; and wherein the first and second output rectifier branches are coupled in parallel across first and second terminals of the output terminal block.

19. The LED driver of claim 18, wherein the user interface comprises a plurality of user selectable switches corresponding to the plurality of circuit branches, wherein the switching element for a given circuit branch is driven between an open and closed state based on a condition of an associated user selectable switch.

20. The LED driver of claim 19, further comprising:

first and second DC buffering capacitors coupled in series between the DC input and an input circuit ground; and wherein the input power converter comprises first and second inverter switching elements coupled across the first and second DC buffering capacitors, and the primary transformer winding is coupled on a first end to the node between the inverter switching elements and on a second end to a node between the first and second DC buffering capacitors.

* * * * *